US011300302B2

(12) United States Patent
Hamada et al.

(10) Patent No.: US 11,300,302 B2
(45) Date of Patent: Apr. 12, 2022

(54) AIR CONDITIONER SYSTEM, AIR CONDITIONER CONTROL DEVICE, AIR CONDITIONER METHOD, AND PROGRAM FOR CONTROL USING WATER CIRCULATION AND BASED ON INDOOR LATENT AND SENSIBLE HEAT LOADS

(71) Applicant: Mitsubishi Electric Corporation, Tokyo (JP)

(72) Inventors: Mamoru Hamada, Tokyo (JP); Masaki Toyoshima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 271 days.

(21) Appl. No.: 16/327,027

(22) PCT Filed: Oct. 24, 2016

(86) PCT No.: PCT/JP2016/081500
§ 371 (c)(1),
(2) Date: Feb. 21, 2019

(87) PCT Pub. No.: WO2018/078709
PCT Pub. Date: May 3, 2018

(65) Prior Publication Data

US 2019/0242597 A1 Aug. 8, 2019

(51) Int. Cl.
*F24F 11/85* (2018.01)
*F25B 7/00* (2006.01)
(Continued)

(52) U.S. Cl.
CPC ..... *F24F 5/0003* (2013.01); *F24F 1/00077* (2019.02); *F24F 3/06* (2013.01);
(Continued)

(58) Field of Classification Search
CPC ..... F25B 7/00; F25B 25/005; F25B 2700/12271; F25B 2700/21172;
(Continued)

(56) References Cited

U.S. PATENT DOCUMENTS 6,269,650 B1 8/2001 Shaw
8,548,607 B1 * 10/2013 Belz ..... G05B 15/02 700/21
(Continued)

FOREIGN PATENT DOCUMENTS

EP 2 466 220 A1 6/2012
JP H09-033089 A 2/1997
(Continued)

OTHER PUBLICATIONS

Extended European Search Report dated Sep. 26, 2019 issued in corresponding EP patent application No. 16920313.0.
(Continued)

*Primary Examiner* — Jerry-Daryl Fletcher
*Assistant Examiner* — Daniel C Comings
(74) *Attorney, Agent, or Firm* — Posz Law Group, PLC

(57) ABSTRACT

An air-conditioning system includes a heat source unit, an air conditioner connected via piping to the heat source unit and configured to perform heat exchange between water supplied by the heat source unit and indoor air, a water circulation device for circulating the water between the heat source unit and the air conditioner, and an air-conditioning control device. The air-conditioning control device controls the heat source unit to lower temperature of the water flowing into the air conditioner, in accordance with an increase in an indoor humidity, and controls the water circulation device to lower temperature of the water flowing from the air conditioner back to the heat source unit, in accordance with an increase in an indoor temperature.

20 Claims, 11 Drawing Sheets

(51) Int. Cl.

| | |
|---|---|
| ***F25B 25/00*** | (2006.01) |
| ***F24F 5/00*** | (2006.01) |
| ***F24F 3/06*** | (2006.01) |
| ***F24F 11/87*** | (2018.01) |
| ***F25B 13/00*** | (2006.01) |
| ***F24F 1/0007*** | (2019.01) |
| ***F24F 11/64*** | (2018.01) |
| ***F24F 11/86*** | (2018.01) |
| *F24F 120/10* | (2018.01) |
| *F24F 110/10* | (2018.01) |
| *F24F 110/20* | (2018.01) |
| *F24F 140/20* | (2018.01) |

(52) U.S. Cl.

CPC ..... *F24F 11/64* (2018.01); *F24F 11/85* (2018.01); *F24F 11/86* (2018.01); *F24F 11/87* (2018.01); *F25B 7/00* (2013.01); *F25B 13/00* (2013.01); *F25B 25/005* (2013.01); *F24F 2110/10* (2018.01); *F24F 2110/20* (2018.01); *F24F 2120/10* (2018.01); *F24F 2140/20* (2018.01); *F24F 2203/021* (2013.01); *F25B 2700/21172* (2013.01); *F25B 2700/21173* (2013.01)

(58) Field of Classification Search

CPC ..... F25B 2700/21173; F24F 5/0003; F24F 3/06; F24F 11/64; F24F 11/83; F24F 11/85; F24F 11/86; F24F 11/87; F24F 2110/10; F24F 2110/20; F24F 2120/20; F24F 2203/021; F24F 2140/20

See application file for complete search history.

(56) References Cited

U.S. PATENT DOCUMENTS

| | | | | |
|---|---|---|---|---|
| 8,930,029 | B2 * | 1/2015 | Desrochers | F24F 11/30 700/276 |
| 2007/0107450 | A1 | 5/2007 | Sasao et al. | |
| 2010/0006662 | A1 * | 1/2010 | Yonezawa | F24F 5/0096 236/440 |
| 2015/0115047 | A1 * | 4/2015 | Okamoto | F24F 11/83 236/1 E |
| 2019/0318386 | A1 | 10/2019 | Takata | |

FOREIGN PATENT DOCUMENTS

| | | | |
|---|---|---|---|
| JP | H09-159284 | A | 6/1997 |
| JP | 2004-069134 | A | 3/2004 |
| WO | 2010/070842 | A1 | 6/2010 |
| WO | 2018/061297 | A1 | 4/2018 |

OTHER PUBLICATIONS

Office Action dated Dec. 2, 2020 issued in corresponding CN patent application No. 201680089826.7 (and English translation).

Office Action dated Nov. 5, 2019 issued in corresponding JP patent application No. 2018-546959 (and English translation).

International Search Report of the International Searching Authority dated Dec. 20, 2016 for the corresponding International application No. PCT/JP2016/081500 (and English translation).

* cited by examiner

AIR CONDITIONER SYSTEM, AIR CONDITIONER CONTROL DEVICE, AIR CONDITIONER METHOD, AND PROGRAM FOR CONTROL USING WATER CIRCULATION AND BASED ON INDOOR LATENT AND SENSIBLE HEAT LOADS

CROSS REFERENCE TO RELATED APPLICATION

This application is a U.S. national stage application of International Patent Application No. PCT/JP2016/081500 filed on Oct. 24, 2016, the content of which is incorporated herein by reference.

TECHNICAL FIELD

The present disclosure relates to a technique for conditioning air in a building.

BACKGROUND

A water-type air-conditioning system for conditioning air by heat exchange between indoor air and cold/hot water that is temperature-controlled by a heat source unit is well known, for example as in Patent Literature 1.

The air-conditioning system of Patent Literature 1 determines a target value of a coil temperature of an air-conditioning coil and a target value of a cold/hot water temperature of a heat source unit so as to achieve the lowest power requirements for air conditioning, including power of the heat source unit that produces cold/hot water, power of a fan that delivers air that has undergone heat exchange through the air-conditioning coil, and power of a pump that delivers cold/hot water from the heat source unit. The air-conditioning system then controls the fan and the pump so that the coil temperature and the cold/hot water temperature reach the determined target values of the coil temperature and the cold/hot water temperature.

PATENT LITERATURE

Patent Literature 1: Unexamined Japanese Patent Application Kokai Publication No. 2004-69134

In the water-type air-conditioning system, however, useful techniques of conditioning air at an appropriate sensible heat capacity and an appropriate latent heat capacity in consideration to a sensible heat load and a latent heat load in an air-conditioning target area have not been suggested as yet.

In view of the above circumstances, an objective of the present disclosure is to provide an air-conditioning system and the like capable of conditioning air at an appropriate sensible heat capacity corresponding to the sensible heat load and an appropriate latent heat capacity corresponding to the latent heat load.

SUMMARY

To achieve the above objective, an air-conditioning system according to the present disclosure includes a heat source unit configured to supply temperature-controlled water, an air conditioner configured to perform heat exchange between the water supplied by the heat source unit and air taken in from an indoor space, water circulation means for circulating the water between the heat source unit and the air conditioner, and water temperature control means. The water temperature control means controls the heat source unit to lower temperature of the water supplied by the heat source unit, in accordance with an increase in an indoor humidity of the indoor space, and a discharge rate of the water circulation means to lower the temperature of the water flowing from the air conditioner back to the heat source unit, in accordance with an increase in an indoor temperature of the indoor space.

According to the present disclosure, water flowing into the air conditioner has the temperature lowered in accordance with the increase in the indoor humidity, and water flowing from the air conditioner back to the heat source unit has the temperature lowered in accordance with the increase in the indoor temperature. Thus air conditioning can be performed at an appropriate sensible heat capacity corresponding to a sensible heat load and an appropriate latent heat capacity corresponding to a latent heat load.

DETAILED DESCRIPTION

Embodiments of the present disclosure are described below in detail with reference to the drawings.

Embodiment 1

Figure 1:
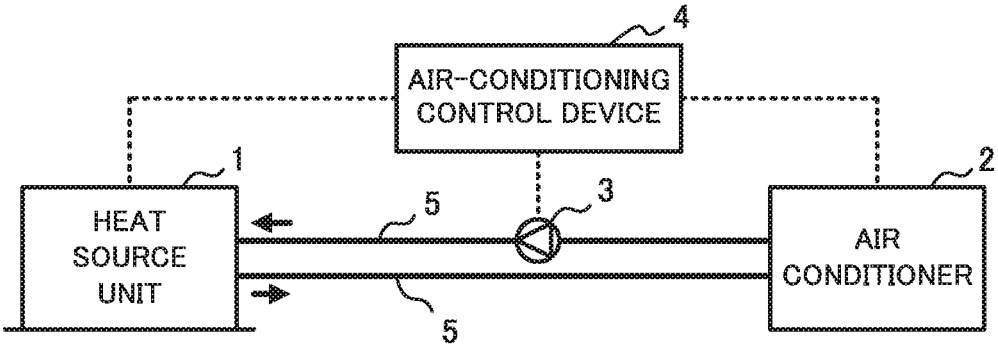
FIG. 1 is a drawing illustrating an overall configuration of an air-conditioning system according to Embodiment 1 of the present disclosure.

FIG. 1 is a drawing illustrating an overall configuration of an air-conditioning system according to Embodiment 1 of the present disclosure. This air-conditioning system is a system for air-conditioning a building such as an office building by use of cold water or hot water (hereinafter referred to as cold/hot water). The air-conditioning system includes a heat source unit 1, an air conditioner 2, a water circulation device 3, and an air-conditioning control device 4.

Figure 2:
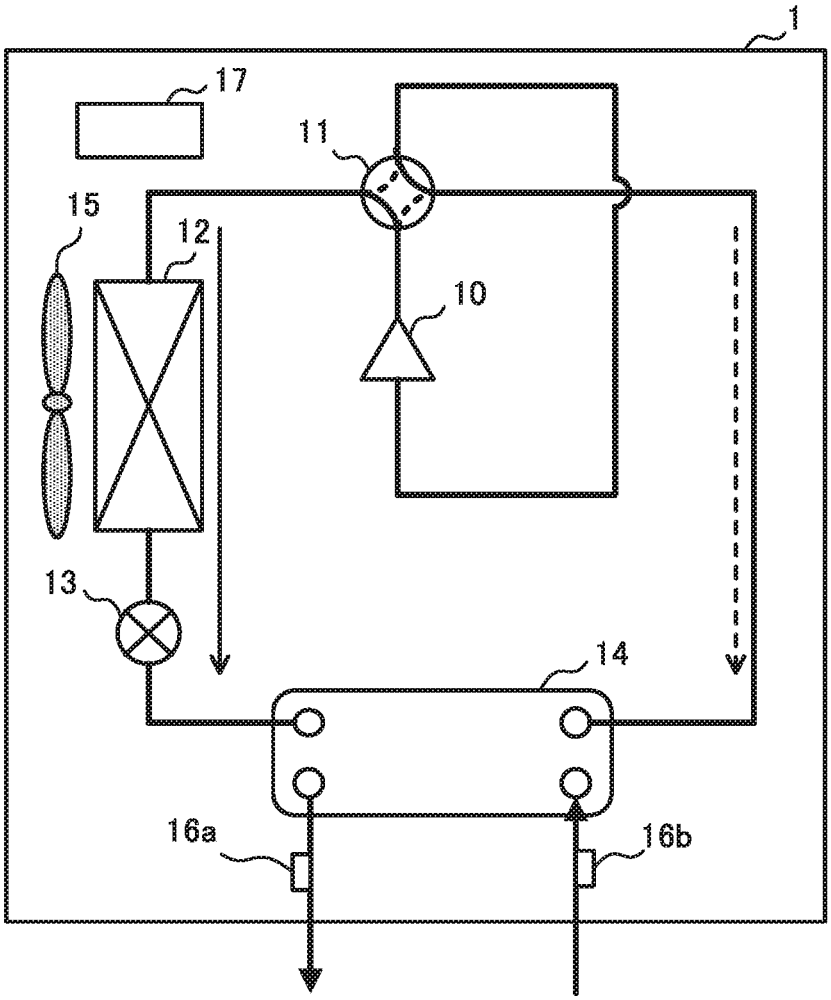
FIG. 2 is a block diagram illustrating a configuration of a heat source unit.

The heat source unit 1 is connected via piping 5 (water piping) to the air conditioner 2, and supplies temperature-controlled cold/hot water to the air conditioner 2. As illustrated in FIG. 2, the heat source unit 1 includes a compressor 10, a four-way valve 11, a first heat exchanger 12, an expansion valve 13, a second heat exchanger 14, a fan 15, temperature sensors 16*a* and 16*b*, and a control board 17. The compressor 10, the four-way valve 11, the first heat exchanger 12, the expansion valve 13, and the second heat exchanger 14 are connected circularly, forming a refrigerant circuit (also referred to as a refrigeration cycle circuit) for circulation of refrigerant such as $CO_2$ or a hydrofluorocarbon (HFC).

The compressor 10 compresses refrigerant to increase temperature and pressure of the refrigerant. The compressor 10 includes an inverter circuit that is capable of varying volumetric rate (an amount of refrigerant discharged per unit) in accordance with a drive frequency. The compressor 10 changes the drive frequency in accordance with a command from the control board 17.

The four-way valve 11 is a valve for changing a circulation direction of the refrigerant. In a cooling operation, the four-way valve 11 is switched to a state indicated by a solid line in FIG. 2. This allows the refrigerant to circulate in a direction indicated by an arrow with a solid line, that is, through the compressor 10, the four-way valve 11, the first heat exchanger 12, the expansion valve 13, and the second heat exchanger 14 in this order in the cooling operation. By contrast, in a heating operation, the four-way valve 11 is switched to a state indicated by dashed lines. This allows the refrigerant to circulate in a direction indicated by an arrow with dashed lines, through the compressor 10, the four-way valve 11, the second heat exchanger 14, the expansion valve 13, and the first heat exchanger 12 in this order in the heating operation.

The first heat exchanger 12 is a heat exchanger for exchanging heat between outside air and the refrigerant, an example of which is a cross-fin tube type heat exchanger formed by a heat transfer tube and fins.

The fan 15 supplies the outside air to the first heat exchanger 12, and examples of the fan 15 include a centrifugal fan and a multi-blade fan that are driven by a DC fan motor or the like. The rotation frequency of the fan 15, that is, a flow rate of outside air to be supplied to the first heat exchanger 12, is changed in accordance with a command from the control board 17.

The expansion valve 13 is a flow control valve for regulating a flow rate of the refrigerant, an example of which is an electronic expansion valve that can adjust a degree of opening of a throttle of the valve by a stepping motor (not illustrated). Another example that can be used as the expansion valve 13 may be a mechanical expansion valve with a diaphragm provided at a pressure-receiving portion, a capillary tube, or the like. The degree of opening of the expansion valve 13 is changed in accordance with a command from the control board 17.

The second heat exchanger 14 is a heat exchanger for exchanging heat between refrigerant and cold/hot water, an example of which is a plate type or double tube type heat exchanger.

The temperature sensor 16*a* measures a temperature of cold/hot water flowing out from the heat source unit 1, in other words, cold/hot water that flows into the air conditioner 2. This temperature is also hereinafter referred to as an outlet temperature of the heat source unit 1. The temperature sensor 16*b* measures a temperature of cold/hot water flowing into the heat source unit 1, in other words, cold/hot water flowing from the air conditioner 2 back to the heat source unit 1. This temperature is also hereinafter referred to as an inlet temperature of the heat source unit 1. The temperature sensors 16*a* and 16*b* send data indicating their respective measured temperatures to the control board 17 at a predetermined timing (e.g., at regular time intervals).

The control board 17 includes a central processing unit (CPU), a read only memory (ROM), a random access memory (RAM), a communication interface, and a readable/writable non-volatile semiconductor memory, none of which are illustrated. The control board 17 is communicatively connected to the compressor 10, the four-way valve 11, the expansion valve 13, the fan 15, and the temperature sensors 16*a* and 16*b* via their corresponding communication lines (not illustrated). The control board 17 is also communicatively connected to the air-conditioning control device 4 in a wired or wireless manner. The control board 17 controls the above described components in accordance with commands from the air-conditioning control device 4, details of which are described later.

Figure 3:
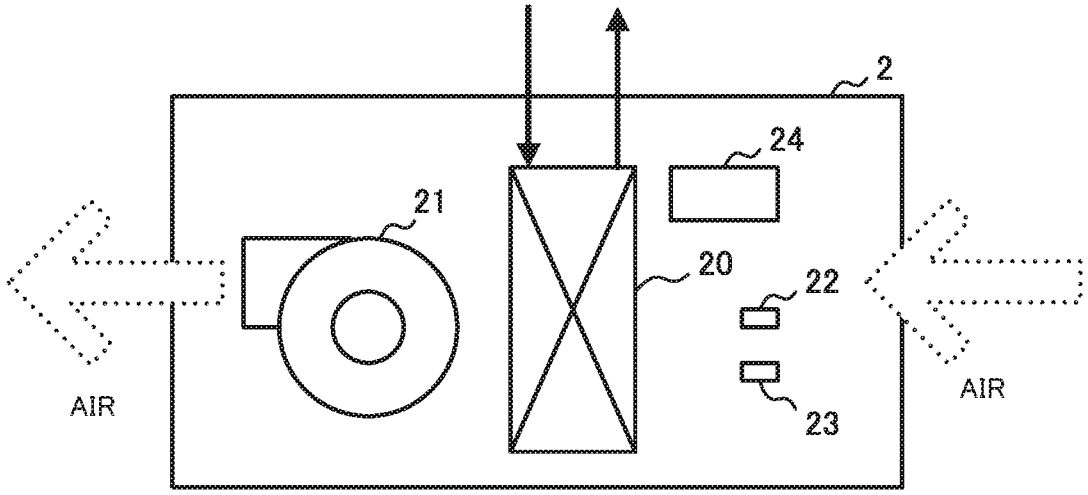
FIG. 3 is a block diagram illustrating a configuration of an air conditioner according to Embodiment 1.

Referring again to FIG. 1, the air conditioner 2 is an air conditioner that is generally referred to as a fan coil unit, and controls conditions (temperature and humidity) of indoor air by performing heat exchange between cold/hot water from the heat source unit 1 and the indoor air. As illustrated in FIG. 3, the air conditioner 2 includes a heat exchanger 20, a fan 21, a temperature sensor 22, a humidity sensor 23, and a control board 24.

The heat exchanger 20 exchanges heat between the cold/hot water received from the heat source unit 1 and the indoor air. The fan 21 takes in (sucks in) air from the indoor space and releases to the indoor space the air having undergone heat exchange.

The temperature sensor 22 measures a temperature (suction temperature) of the sucked-in air. The humidity sensor 23 measures a humidity (suction humidity) of the sucked-in air. The temperature sensor 22 and the humidity sensor 23 send, to the control board 24, data indicating the measured suction temperature and data indicating the measured suction humidity, respectively, at a predetermined timing (e.g., at regular time intervals).

The control board 24 includes a CPU, a ROM, a RAM, a communication interface, and a readable/writable non-volatile semiconductor memory, none of which are illustrated. The control board 24 is communicatively connected to the air-conditioning control device 4 in a wired or wireless manner, and starts or stops driving of the fan 21 in accordance with a command from the air-conditioning control device 4. The control board 24 sends data (indoor condition data) to the air-conditioning control device 4 in response to a request from the air-conditioning control device 4. The indoor condition data includes the suction temperature measured by the temperature sensor 22 and the suction humidity measured by the humidity sensor 23. Sending of the indoor condition data to the air-conditioning control device 4 by the control board 24 may be autonomous sending at regular time intervals.

Referring again to FIG. 1, the water circulation device 3 (water circulation means) is a pump for circulating cold/hot water between the heat source unit 1 and the air conditioner 2 via the piping 5. The water circulation device 3 is communicatively connected to the air-conditioning control device 4 in a wired or wireless manner. The water circulation device 3 includes an inverter circuit, and the drive rotation frequency of the water circulation device 3 is changed in accordance with a command from the air-conditioning control device 4. This can change a discharge rate, that is, a flow rate of the cold/hot water circulating between the heat source unit 1 and the air conditioner 2.

Figure 4:
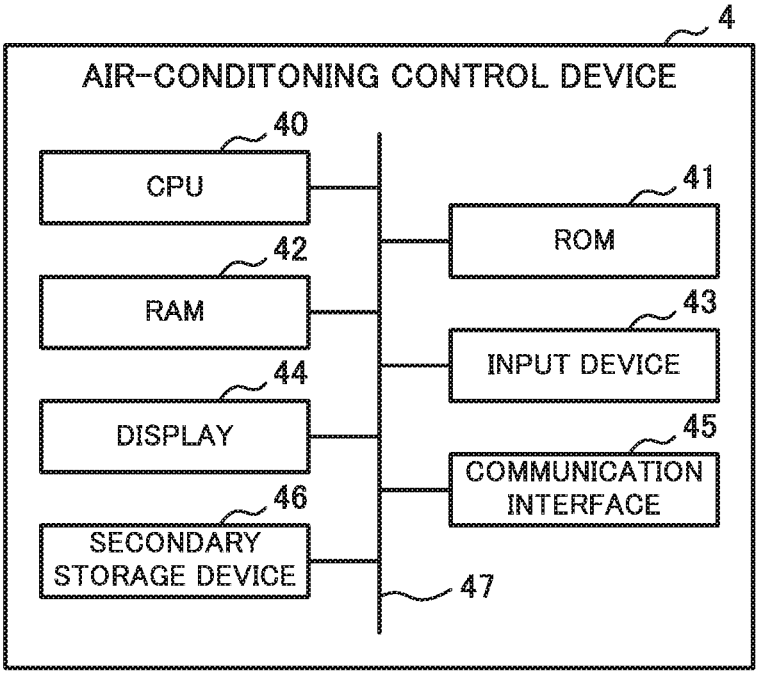
FIG. 4 is a block diagram illustrating a hardware configuration of an air-conditioning control device.

The air-conditioning control device 4 (water temperature control means) is an air-conditioning remote controller installed near an entrance area for the indoor space to be air-conditioned. As illustrated in FIG. 4, the air-conditioning control device 4 includes a CPU 40, a ROM 41, a RAM 42, an input device 43, a display 44, a communication interface 45, and a secondary storage device 46. These components are connected to one another via a bus 47. The CPU 40 performs overall control of the air-conditioning control device 4. Functions implemented by the CPU 40 are described later in detail.

The ROM 41 stores more than one firmware, data for use in execution of the firmware, and the like. The RAM 42 is used as a working space for the CPU 40. The input device 43 includes a push button, a touch panel, and/or a touch pad, and accepts a user operation and sends to the CPU 40 a signal relating to the accepted operation.

The display 44 is a display device such as a liquid crystal display and an organic electroluminescent (EL) display, and displays, under control of the CPU 40, an operation screen relating to air conditioning of the indoor space and information such as conditions of the indoor air. The communication interface 45 includes a network interface card/controller (NIC) for wired or wireless communication between the control board 17 of the heat source unit 1 and the control board 24 of the air conditioner 2.

The secondary storage device 46 includes a readable/writable non-volatile semiconductor memory, such as an electrically erasable programmable read-only memory (EEPROM) or a flash memory. The secondary storage device 46 stores at least one program relating to air-conditioning control, data for use in execution of the program, and the like.

Figure 5:
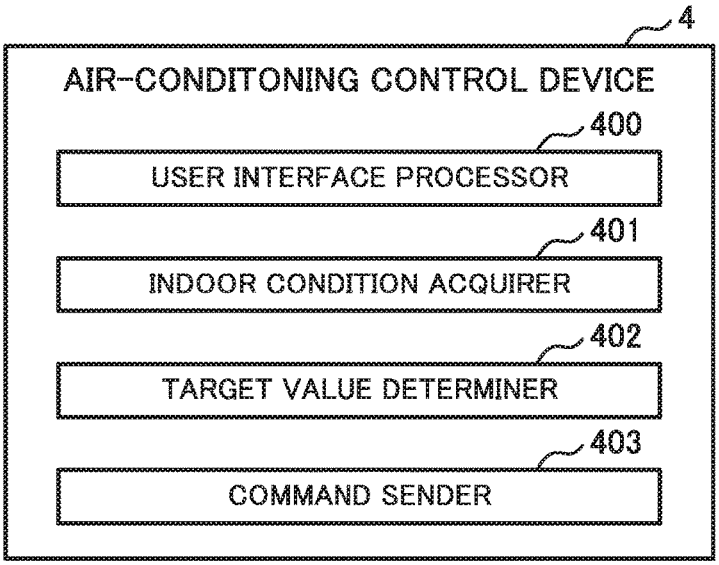
FIG. 5 is a diagram illustrating a functional configuration of the air-conditioning control device according to Embodiment 1.

Next, the functions of the air-conditioning control device 4 are described. As illustrated in FIG. 5, the air-conditioning control device 4 functionally includes a user interface processor 400, an indoor condition acquirer 401, a target value determiner 402, and a command sender 403. These functional features are implemented by the CPU 40 by execution of the program stored in the secondary storage device 46.

A user interface processor 400 performs user interface processing via the input device 43 and the display 44. That is, the user interface processor 400 accepts a user operation via the input device 43. The user interface processor 400 outputs, to the display 44, information for presentation to a user.

The indoor condition acquirer 401 acquires, upon start of operation (cooling operation, heating operation), conditions of the indoor air, that is, an indoor temperature and an indoor humidity at regular time intervals. Specifically, the indoor condition acquirer 401 requests indoor conditions from the air conditioner 2 at the time of start of the operation, and after the start of the operation, repeats the request at regular time intervals (e.g., at one-minute intervals). The indoor condition acquirer 401 acquires the indoor temperature and the indoor humidity by receiving the above-mentioned indoor condition data sent by the air conditioner 2 in response to the request and extracting the suction temperature and the suction humidity included in the received indoor condition data. The indoor condition acquirer 401 does not need to send the above request in a case in which the indoor condition data is sent autonomously from the air conditioner 2 at regular time intervals.

The target value determiner 402 determines, based on the acquired indoor temperature, a target value of the temperature (inlet temperature of the heat source unit 1) of cold/hot water flowing back to the heat source unit 1. The target value determiner 402 also determines, based on the acquired indoor humidity, a target value (outlet temperature of the heat source unit 1) of cold/hot water flowing out from the heat source unit 1 into the air conditioner 2.

Figure 6:
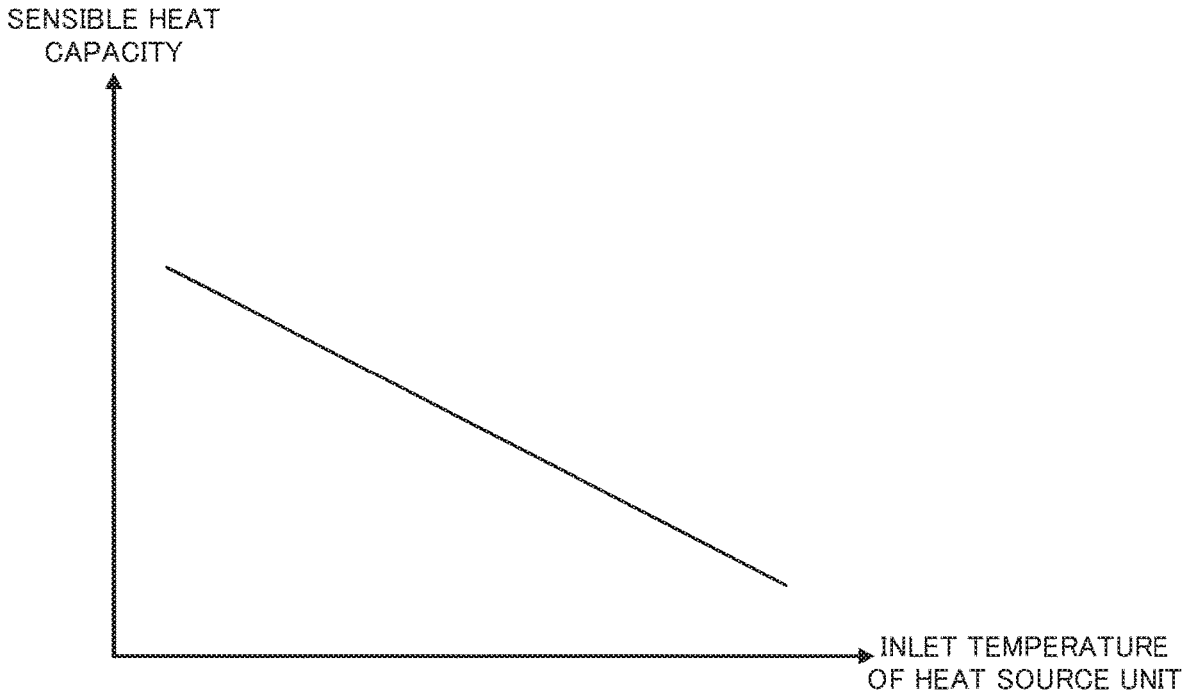
FIG. 6 is a graph illustrating a relationship between a sensible heat capacity of the air conditioner and an inlet temperature of the heat source unit.

When the outlet temperature of the heat source unit 1 is fixed, that is to say, is controlled not to change, a sensible heat capacity of the air conditioner 2 and the inlet temperature of the heat source unit 1 during the cooling operation typically have a relationship as indicated in FIG. 6. The relationship of FIG. 6 indicates that the higher the inlet temperature of the heat source unit 1, the less the sensible heat capacity. From such a relationship, it can be said that changing the inlet temperature of the heat source unit 1 enables control of the sensible heat capacity of the air conditioner 2.

Figure 7:
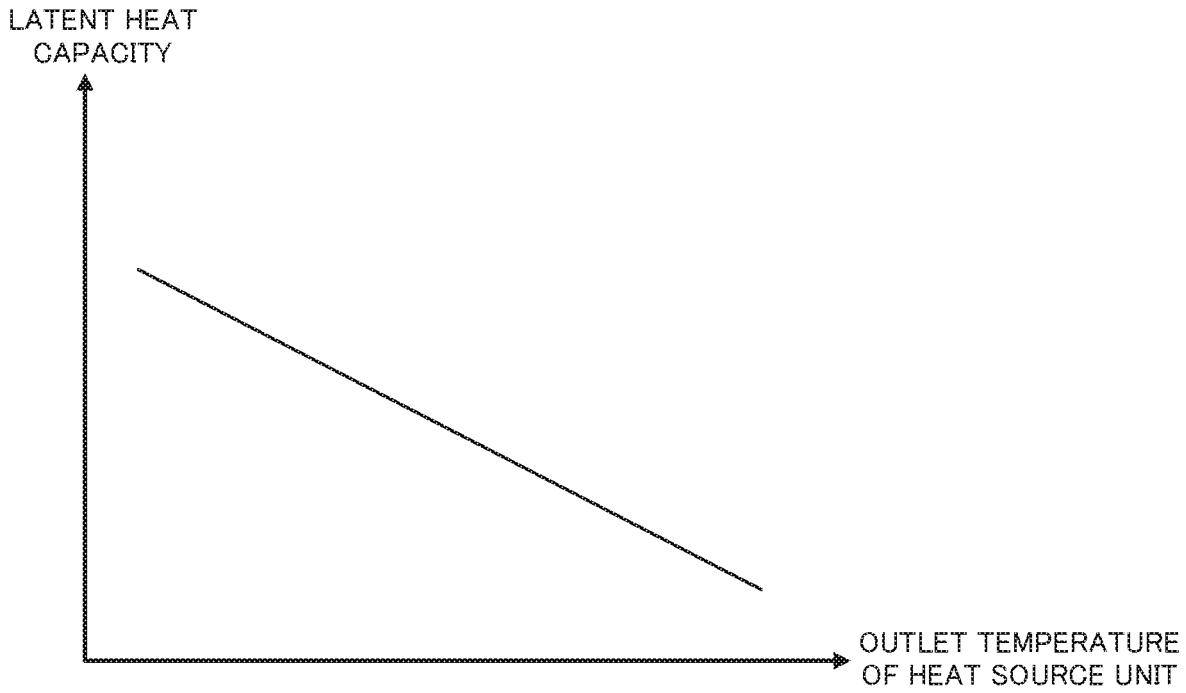
FIG. 7 is a graph illustrating a relationship between a latent heat capacity of the air conditioner and an outlet temperature of the heat source unit.

Assuming that $\Delta T$ is constant, that is, no change in $\Delta T$ occurs, where $\Delta T$ is the inlet temperature of the heat source unit 1 minus the outlet temperature of the heat source unit 1, a latent heat capacity (i.e., dehumidification capacity) of the air conditioner 2 and the outlet temperature of the heat source unit 1 during the cooling operation typically have a relationship as indicated in FIG. 7. The relationship of FIG. 7 indicates that the higher the outlet temperature of the heat source unit 1, the less the latent heat capacity. From such a relationship, it can be said that changing the outlet temperature of the heat source unit 1 enables control of the latent heat capacity of the air conditioner 2.

In the present embodiment, the indoor temperature is regarded as a sensible heat load and the indoor humidity is regarded as a latent heat load, and based on the premise, the target value determiner 402 determines a target value of the inlet temperature of the heat source unit 1 and a target value of the outlet temperature of the heat source unit 1. In the determination, the target value determiner 402 uses a predefined correlation between the target value of the inlet temperature and the indoor temperature and a predefined correlation between the target value of the outlet temperature and the indoor humidity, which are correlations as illustrated in FIGS. 8 and 9.

Figure 8:
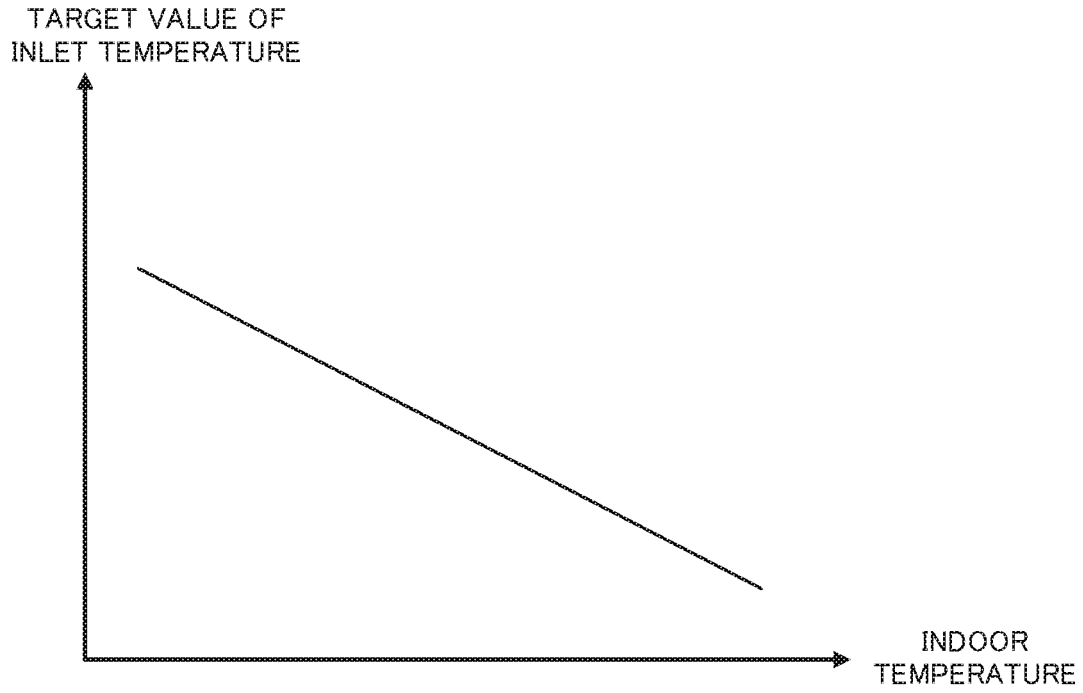
FIG. 8 is a graph illustrating a correlation between a target value of the inlet temperature of the heat source unit and an indoor temperature.
Figure 9:
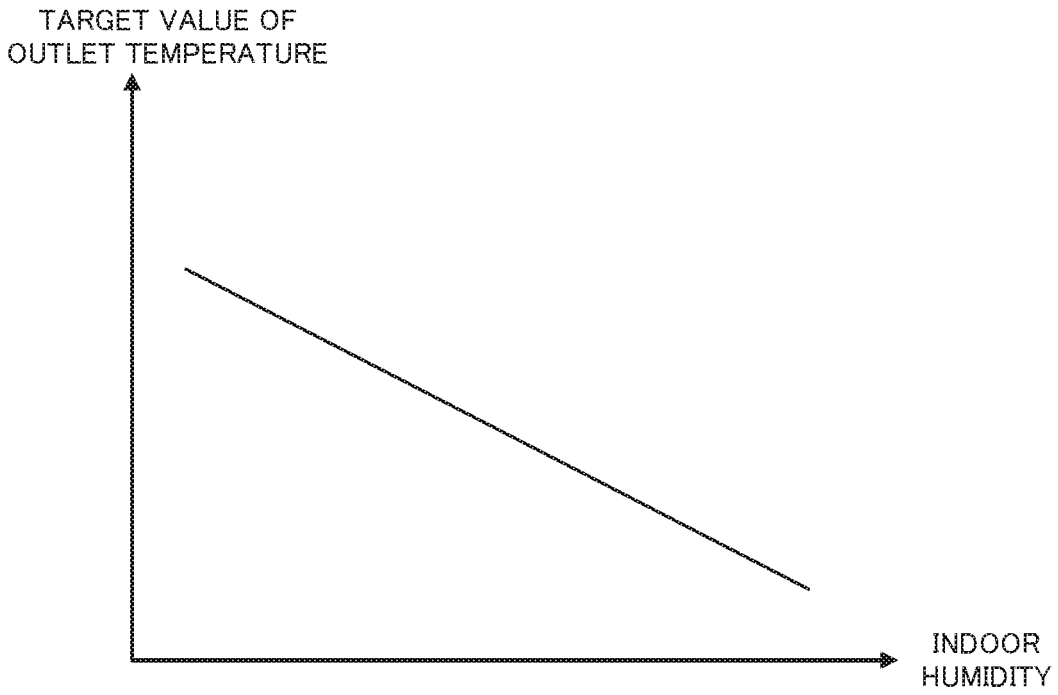
FIG. 9 is a graph illustrating a correlation between a target value of the outlet temperature of the heat source unit and an indoor humidity.

FIG. 8 indicates that the higher the indoor temperature, the lower the target value of the inlet temperature of the heat source unit 1, while FIG. 9 indicates that the higher the indoor humidity, the lower the target value of the outlet temperature of the heat source unit 1. Although FIGS. 8 and 9 both indicate a linear variation, that is, a linear relationship, the relationship is not limited thereto. For example, the relationship may vary curvilinearly or intermittently. That is, the relationships may have any form of variation as long as there is a correlation such that the higher the indoor temperature, the lower the target value of the inlet temperature and there is a correlation such that the higher the indoor humidity, the lower the target value of the outlet temperature.

Specifically, the target value determiner 402 determines the target value of the inlet temperature of the heat source unit 1 from the indoor temperature using a predefined relational expression or a look-up table (hereinafter collectively referred to as "Relational Expression") that indicates the correlation indicated in FIG. 8. Similarly, the target value determiner 402 determines the target value of the outlet temperature of the heat source unit 1 from the indoor humidity using a predefined Relational Expression that indicates the correlation indicated in FIG. 9.

Here, Relational Expressions that indicate a correlation between the indoor temperature and the target value of the inlet temperature of the heat source unit 1, which is also hereinafter referred to as a first correlation, are prepared in advance in accordance with conditions of operation. That is, Relational Expressions that indicate the first correlation, corresponding to set temperatures (target indoor temperature), are prepared in advance for each type of operation mode (cooling operation, heating operation). The same applies to Relational Expressions that indicate a correlation between the indoor humidity and the target value of the outlet temperature of the heat source unit 1, which is also hereinafter referred to as a second correlation.

For example, when the current operation mode is the cooling operation and the set temperature is 25° C., the target value determiner 402 determines the target value of the inlet temperature of the heat source unit 1 by selecting and using Relational Expression that indicates the first correlation, corresponding to the set temperature of 25° C. in the mode of cooling operation. The target value determiner 402 also determines the target value of the outlet temperature of the heat source unit 1 by selecting and using Relational Expression that indicates the second correlation, corresponding to the set temperature of 25° C. in the mode of cooling operation.

Referring again to FIG. 5, the command sender 403 generates commands for control of the heat source unit 1, the air conditioner 2, and the water circulation device 3, and sends each command to the corresponding component.

For example, the command sender 403 sends, to the heat source unit 1, any of an operation start command, an operation stop command, and a target value change command, depending on the situation. The operation start command is sent when an action to start an operation is taken by a user. The operation start command includes an identifier indicating an instruction of a start of operation, a type of operation mode (cooling operation, heating operation), and a target value, determined by the target value determiner 402, of the outlet temperature of the heat source unit 1.

The control board 17 of the heat source unit 1, upon receiving the above-described operation start command, performs an operation in accordance with content specified by the received operation start command That is, the control board 17 switches the four-way valve 11 in accordance with the specified type of operation mode, and controls each component (compressor 10, expansion valve 13, fan 15, etc.) so that the temperature of the cold/hot water to be delivered to the air conditioner 2 reaches the specified target value.

The operation stop command is sent when an action to stop an operation is taken by a user. The operation stop command includes an identifier indicating an instruction of a stop of operation. The control board 17, upon receiving the operation stop command, stops the operation of the heat source unit 1.

The target value change command is sent at regular time intervals (e.g., at one-minute intervals) after start of the operation. The target value change command includes an identifier indicating an instruction of a change of a target value, and a target value, determined by the target value determiner 402, of the outlet temperature of the heat source unit 1. Instead of sending at regular time intervals, the command sender 403 may send the target value change command to the heat source unit 1 when the currently determined target value differs from the previously determined target value.

The control board 17 of the heat source unit 1, upon receiving the target value change command, controls each component (compressor 10, expansion valve 13, fan 15, etc.) so that the temperature of the cold/hot water to be delivered to the air conditioner 2 reaches the specified target value.

The command sender 403 also sends, to the air conditioner 2, either of an air-blowing start command or an air-blowing stop command, depending on the situation. The air-blowing start command is sent when an action to start an operation is taken by a user. The air-blowing start command includes an identifier indicating an instruction of a start of air-blowing. The control board 24 of the air conditioner 2, upon receiving the air-blowing start command, causes the fan 21 to rotate at a predetermined rotation frequency.

The air-blowing stop command is sent when an action to stop an operation is taken by a user. The air-blowing stop command includes an identifier indicating an instruction of a stop of air-blowing. The control board 24, upon receiving the air-blowing stop command, stops the rotation of the fan 21.

The command sender 403 also sends any of a drive start command, a drive stop command, and a drive change command to the water circulation device 3. The drive start command is sent when an action to start an operation is taken by a user. The drive start command includes an identifier indicating an instruction of a start of driving and the drive rotation frequency. The command sender 403 determines the drive rotation frequency based on the target value, determined by the target value determiner 402, of the inlet temperature of the heat source unit 1.

The water circulation device 3, upon receiving the drive start command, starts driving at the specified drive rotation frequency, and thereby the delivery of the cold/hot water is started and the cold/hot water circulates between the heat source unit 1 and the air conditioner 2. A flow rate of the circulating cold/hot water varies upon the drive rotation frequency being changed. That is, the increased drive rotation frequency results in a greater flow rate of the cold/hot water, while the reduced drive rotation frequency results in a less flow rate of the cold/hot water. In the cooling operation, the inlet temperature of the heat source unit 1 decreases as the flow rate of cold/hot water increases, while in the heating operation, the inlet temperature of the heat source unit 1 increases as the flow rate of cold/hot water increases.

The drive stop command is sent when an action to stop an operation is taken by a user. The drive stop command includes an identifier indicating an instruction of a stop of driving. The water circulation device 3, upon receiving the drive stop command, stops the delivery of cold/hot water.

The drive change command is sent at regular time intervals (e.g., at one-minute intervals) after start of the operation. The drive change command includes an identifier indicating a change of the drive rotation frequency and the drive rotation frequency newly determined. Instead of sending at regular time intervals, the command sender 403 may send the drive change command to the water circulation device 3 when the drive rotation frequency currently determined differs from the drive rotation frequency previously determined.

The water circulation device 3, upon receiving the drive change command, performs driving at the specified drive rotation frequency to deliver the cold/hot water.

Figure 10:
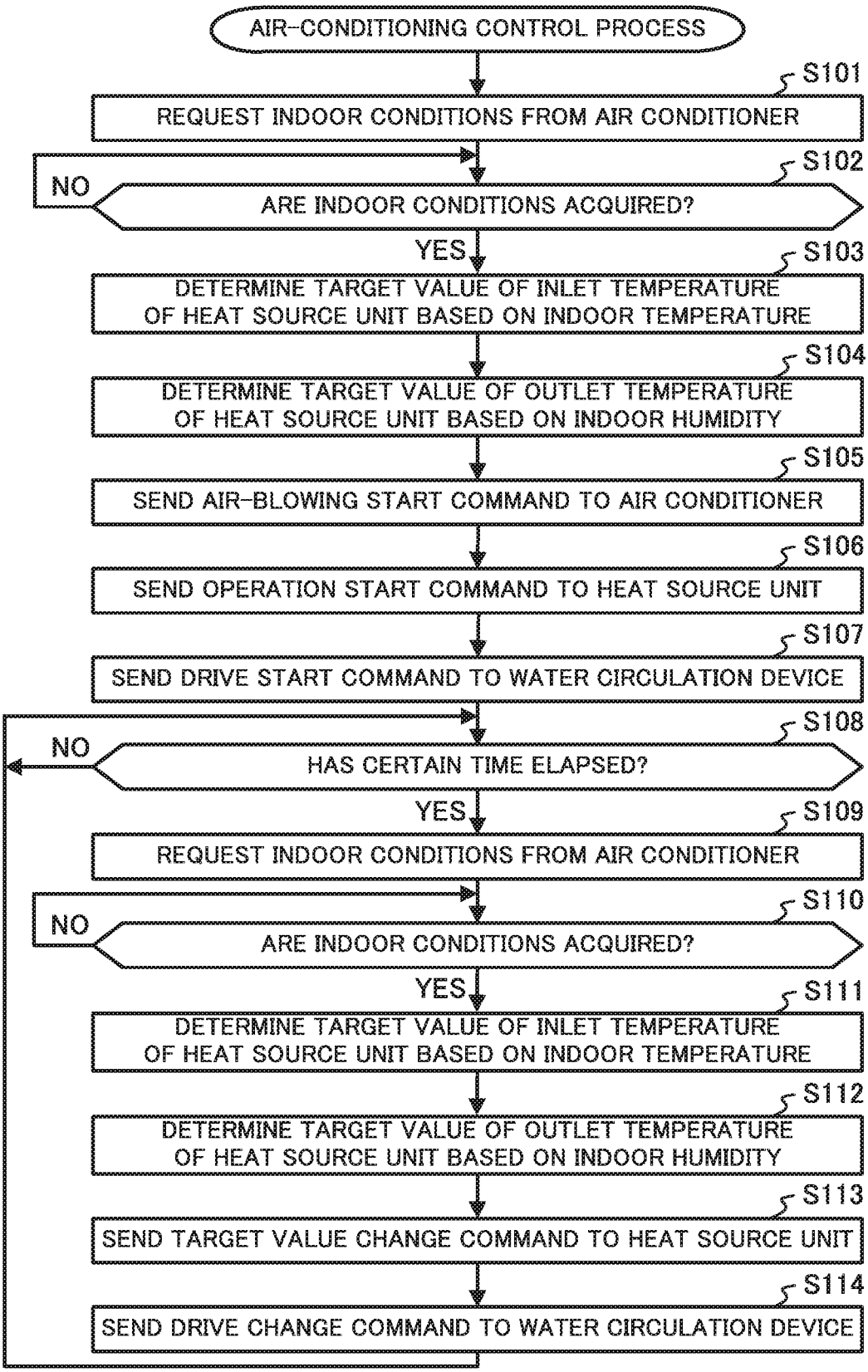
FIG. 10 is a flowchart illustrating steps of an air-conditioning control process.

FIG. 10 is a flowchart illustrating steps of an air-conditioning control process executed by the air-conditioning control device 4. This air-conditioning control process is started by a user action to start the cooling operation or the heating operation.

The indoor condition acquirer 401 requests indoor conditions from the air conditioner 2 (step S101). When the indoor condition acquirer 401 receives the indoor condition data sent by the air conditioner 2 in response to the request, and acquires the indoor conditions (indoor temperature, indoor humidity) (Yes in step S102), the target value determiner 402 determines the target value of the inlet temperature of the heat source unit 1 based on the indoor temperature (step S103). The target value determiner 402 determines the target value of the outlet temperature of the heat source unit 1 based on the indoor humidity (step S104).

The command sender 403 sends the air-blowing start command to the air conditioner 2 (step S105). The command sender 403 also sends, to the heat source unit 1, the operation start command including the determined target value of the outlet temperature of the heat source unit 1 (step S106). Furthermore, the command sender 403 determines the drive rotation frequency of the water circulation device 3 based on the determined target value of the inlet temperature of the heat source unit 1, and sends, to the water circulation device 3, the drive start command including the determined drive rotation frequency (step S107).

After elapse of a certain time (e.g., one minute) (Yes in step S108), the command sender 403 requests the indoor conditions from the air conditioner 2 (step S109).

When the indoor condition acquirer 401 receives the indoor condition data sent by the air conditioner 2 in response to the request and acquires the indoor conditions (indoor temperature, indoor humidity) (Yes in step S110), the target value determiner 402 determines the target value of the inlet temperature of the heat source unit 1 based on the indoor temperature (step S111). The target value determiner 402 also determines the target value of the outlet temperature of the heat source unit 1 based on the indoor humidity (step S112).

The command sender 403 then sends, to the heat source unit 1, the target value change command including the determined target value of the outlet temperature of the heat source unit 1 (step S113). Furthermore, the command sender 403 determines the drive rotation frequency of the water circulation device 3 based on the determined target value of the inlet temperature of the heat source unit 1, and sends, to the water circulation device 3, the drive change command including the determined drive rotation frequency (step S114). Then the air-conditioning control device 4 repeatedly executes the above-described steps S108 to S114 until a user action to stop the operation is taken.

As described above, in the air-conditioning system according to Embodiment 1 of the present disclosure, the indoor temperature is regarded as the sensible heat load and the indoor humidity is regarded as the latent heat load, and determines, based on the premise, the target value of the inlet temperature of the heat source unit 1 and the target value of the outlet temperature of the heat source unit 1. The heat source unit 1 and the water circulation device 3 are then controlled in accordance with the determined target values of the inlet temperature and the determined target value of the outlet temperature.

Such a control can achieve air conditioning at an appropriate sensible heat capacity corresponding to a sensible heat load and can also achieve air conditioning at an appropriate latent heat capacity corresponding to a latent heat load. For example, when the sensible heat load is high at the time of starting the cooling operation, lowering the inlet temperature of the heat source unit 1 enables prompt air conditioning at an appropriate sensible heat capacity corresponding to the sensible heat load. Similarly, when the latent heat load is high at the time of starting the cooling operation, lowering the outlet temperature of the heat source unit 1 enables prompt air conditioning at an appropriate latent heat capacity corresponding to the latent heat load.

Figure 11:
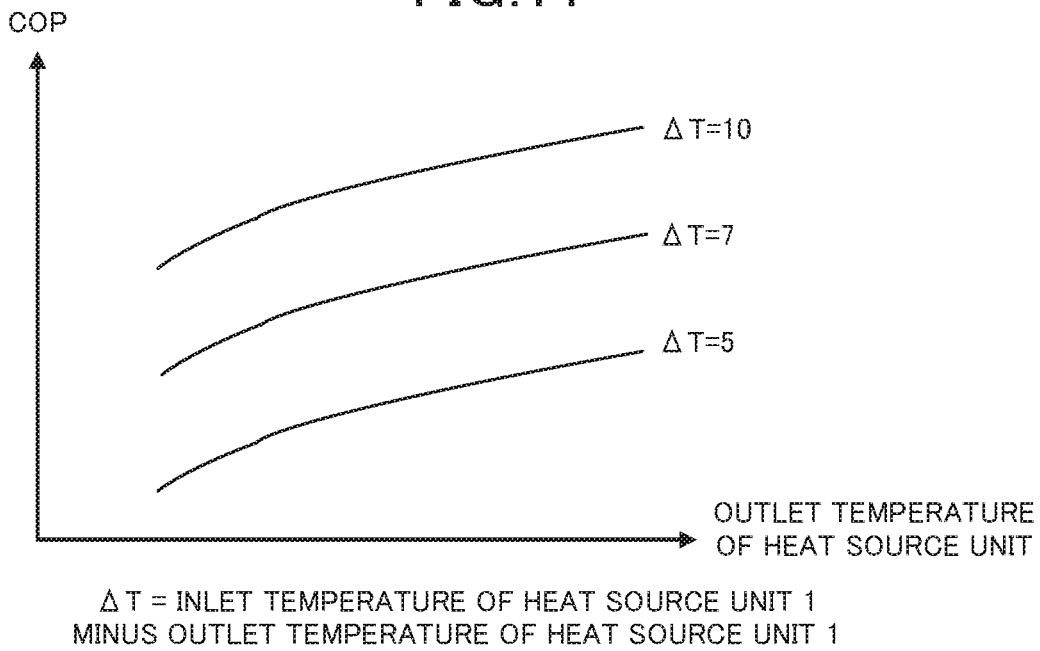
FIG. 11 is a graph illustrating a relationship between COP of the heat source unit and a temperature of cold/hot water.

In contrast, when the sensible heat load decreases over time after start of the cooling operation, the air-conditioning system raises the inlet temperature of the heat source unit 1 and thereby lowers the sensible heat capacity. When the latent heat load decreases, the air-conditioning system correspondingly raises the outlet temperature of the heat source unit 1 and thereby lowers the latent heat capacity. FIG. 11 indicates that as the outlet temperature of the heat source unit 1, that is, the temperature of cold/hot water flowing out from the heat source unit 1 is raised during the cooling operation, a coefficient of performance (COP) of the heat source unit 1 increases. In addition, the COP is likely to be higher as the $\Delta T$ is greater. That is, power to be consumed by the heat source unit 1 can be reduced.

Raising the inlet temperature of the heat source unit 1 leads to reduction of a volume of circulating cold/hot water, thus reducing power to be consumed by the water circulation device 3.

Embodiment 2

Next, Embodiment 2 of the present disclosure is described. In the following description, the components common to Embodiment 1 are assigned the same reference signs as those of Embodiment 1, and the description of such components is omitted.

Figure 12:
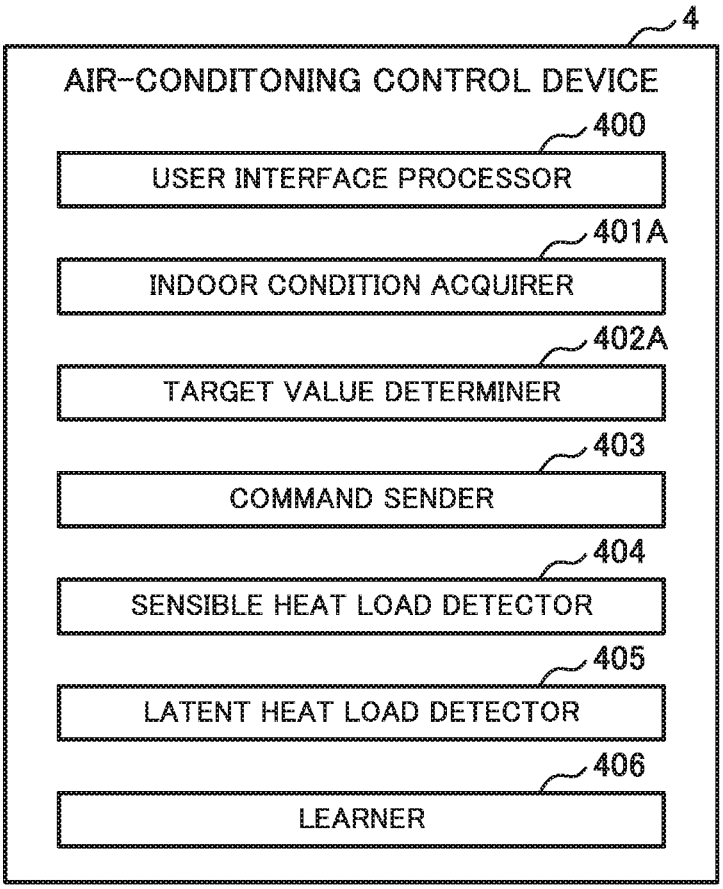
FIG. 12 is a functional configuration of an air-conditioning control device according to Embodiment 2.

FIG. 12 is a drawing illustrating a functional configuration of an air-conditioning control device 4 according to the present embodiment. As illustrated in FIG. 12, the air-conditioning control device 4 includes a user interface processor 400, an indoor condition acquirer 401A, a target value determiner 402A, a command sender 403, a sensible heat load detector 404, a latent heat load detector 405, and a learner 406. These functional features are implemented by the CPU 40 of the air-conditioning control device 4 by execution of a program that is related to air-conditioning control and stored in a secondary storage device 46.

The indoor condition acquirer 401A requests indoor conditions from the air conditioner 2 at the time of start of an operation (cooling operation, heating operation), and after the start of the operation, repeats the request at regular time intervals (e.g., at one-minute intervals), thereby acquiring indoor air conditions (suction temperature, suction humidity, blow temperature, blow humidity, and air flow rate).

Figure 13:
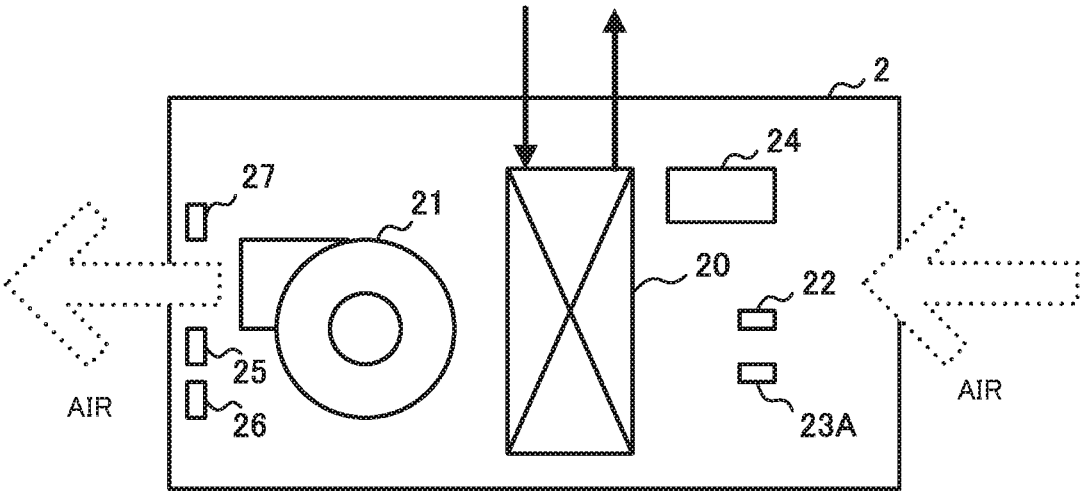
FIG. 13 is a block diagram illustrating a configuration of an air conditioner according to Embodiment 2.

In the present embodiment, in addition to the temperature sensor 22 for measuring the suction temperature, the air conditioner 2 further includes, as sensors for measuring air conditions, a humidity sensor 23A, a temperature sensor 25, a humidity sensor 26, and an air flow sensor 27, as illustrated in FIG. 13.

The humidity sensor 23A measures an absolute humidity (suction humidity) of the sucked-in air. The temperature sensor 25 measures a temperature (blow temperature) of air blown to the indoor space. The humidity sensor 26 measures an absolute humidity (blow humidity) of air blown to the indoor space. The air flow sensor 27 measures a flow rate of air blown to the indoor space. Each sensor sends the measured result to the control board 24 at a predetermined timing (e.g., at regular time intervals).

The control board 24 of the air conditioner 2 sends data (indoor condition data) to the air-conditioning control device 4 in response to the request from the air-conditioning control device 4. The indoor condition data includes the suction temperature, the suction humidity, the blow temperature, the blow humidity, and the air flow rate. Sending of the indoor condition data to the air-conditioning control device 4 by the control board 24 may be autonomous sending at regular time intervals.

Referring again to FIG. 12, the target value determiner 402A determines the target value of the inlet temperature of the heat source unit 1 based on the sensible heat load detected by the sensible heat load detector 404 described later. The target value determiner 402A also determines the target value of the outlet temperature of the heat source unit 1 based on the latent heat load detected by the latent heat load detector 405 described later.

Figure 14:
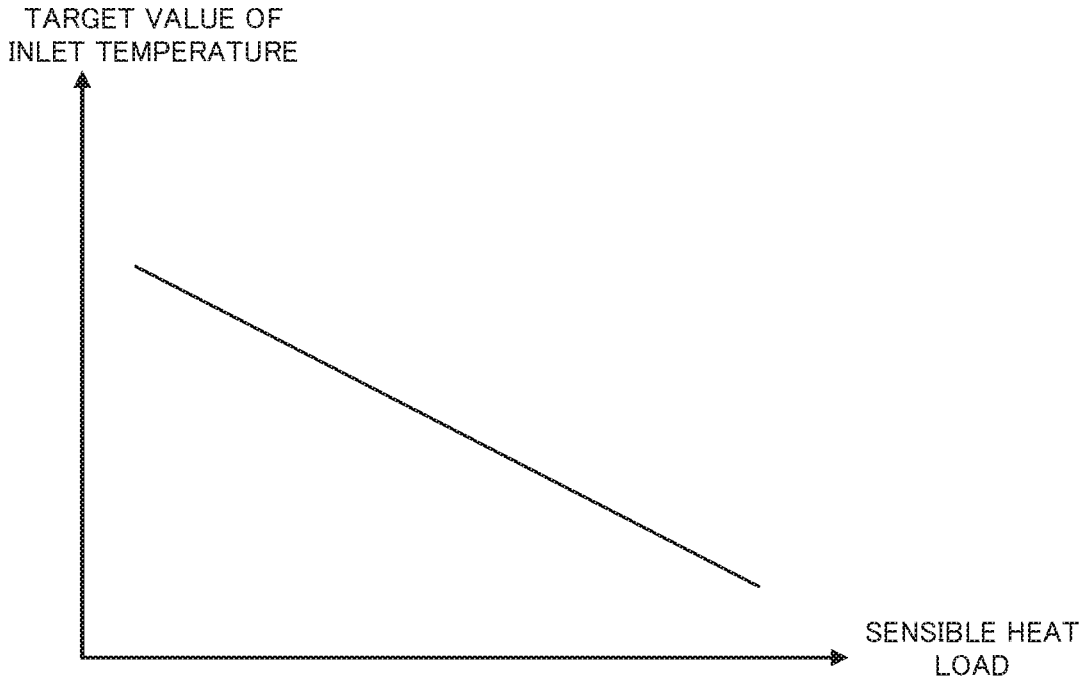
FIG. 14 is a graph illustrating a correlation between the target value of the inlet temperature of the heat source unit and a sensible heat load.
Figure 15:
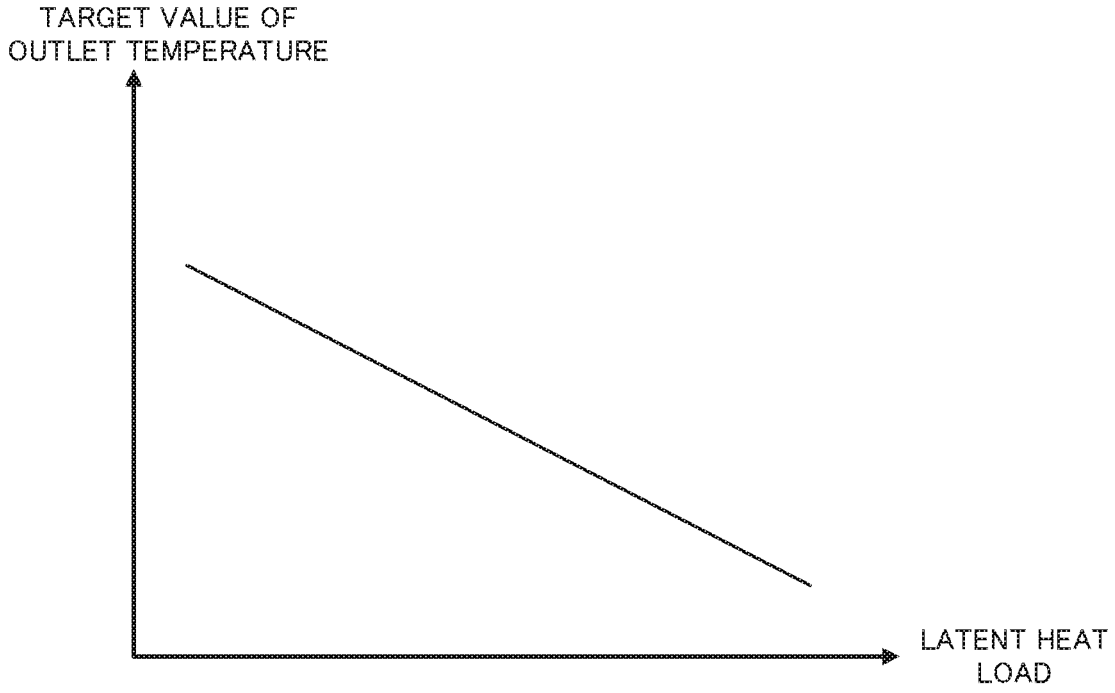
FIG. 15 is a graph illustrating a correlation between the target value of the outlet temperature of the heat source unit and a latent heat load.

The target value determiner 402A uses a predefined correlation between the target value of the inlet temperature and the sensible heat load and a predefined correlation between the target value of the outlet temperature and the latent heat load, as illustrated in FIGS. 14 and 15.

FIG. 14 indicates that the higher the sensible heat load, the lower the target value of the inlet temperature of the heat source unit 1, while FIG. 15 indicates that the higher the latent heat load, the lower the target value of the outlet temperature of the heat source unit 1. Although FIGS. 14 and 15 both indicate a linear variation, that is, a linear relationship, the relationship is not limited thereto. For example, the relationship may vary curvilinearly or intermittently. That is, the relationship may have any form of variation as long as there is a correlation such that the higher the sensible heat load, the lower the target value of the inlet temperature and there is a correlation such that the higher the latent heat load, the lower the target value of the outlet temperature.

Specifically, the target value determiner 402A determines the target value of the inlet temperature of the heat source unit 1 from the sensible heat load using a predefined relational expression or a look-up table (hereinafter collectively referred to as "Relational Expression") that indicates the correlation indicated in FIG. 14. Similarly, the target value determiner 402A determines the target value of the outlet temperature of the heat source unit 1 from the latent heat load using the predefined Relational Expression that indicates the correlation indicated in FIG. 15.

Here, it is assumed that Relational Expressions that indicate a correlation between the sensible heat load and the target value of the inlet temperature of the heat source unit 1, which is also hereinafter referred to as a third correlation, are prepared in advance in accordance with conditions of operation. That is, Relational Expressions that indicate the third correlation, corresponding to set temperatures (target indoor temperature), are prepared in advance for each type of operation mode (cooling operation, heating operation). The same applies to Relational Expressions that indicate a correlation between the latent heat load and the target value of the outlet temperature of the heat source unit 1, which is also hereinafter referred to as a fourth correlation.

For example, when the current operation mode is the cooling operation and the set temperature is 25° C., the target value determiner 402A determines the target value of the inlet temperature of the heat source unit 1 by selecting and using Relational Expression that indicates the third correlation, corresponding to the set temperature of 25° C. in the mode of cooling operation. The target value determiner 402A also determines the target value of the outlet temperature of the heat source unit 1 by selecting and using Relational Expression that indicates the fourth correlation, corresponding to the set temperature of 25° C. in the mode of cooling operation.

Referring again to FIG. 12, the sensible heat load detector 404 detects the current sensible heat load based on the type of operation mode, the set temperature, the suction temperature (that is, indoor temperature) acquired from the air conditioner 2, and Relational Expression that indicates a correlation between the sensible heat load and the indoor temperature, which is also hereinafter referred to as a fifth correlation. Relational Expression that indicates the fifth correlation is developed by the learner 406 described later.

The latent heat load detector 405 detects the current latent heat load based on the type of operation mode, the set temperature, the suction humidity (that is, indoor absolute humidity) acquired from the air conditioner 2, and Relational Expression that indicates a correlation between the latent heat load and the indoor absolute humidity, which is also hereinafter referred to as a sixth correlation. Relational Expression that indicates the sixth correlation is developed by the learner 406 described later.

Here, it is assumed that Relational Expressions that indicate the fifth correlation are developed in advance by the learner 406 in accordance with conditions of operation. That is, Relational Expressions that indicate the fifth correlation, corresponding to set temperatures (target indoor temperature), are developed in advance for each type of operation mode (cooling operation, heating operation). The same applies to Relational Expressions that indicate the sixth correlation.

The learner 406 calculates the current sensible heat capacity of the air conditioner 2 by a well-known calculation method based on the suction temperature, the blow temperature, and the air flow rate that are acquired by the indoor condition acquirer 401A. The learner 406 also calculates the current latent heat capacity of the air conditioner 2 by a well-known calculation method based on the suction humidity, the blow humidity, and the air flow rate that are also acquired by the indoor condition acquirer 401A.

Figure 16:
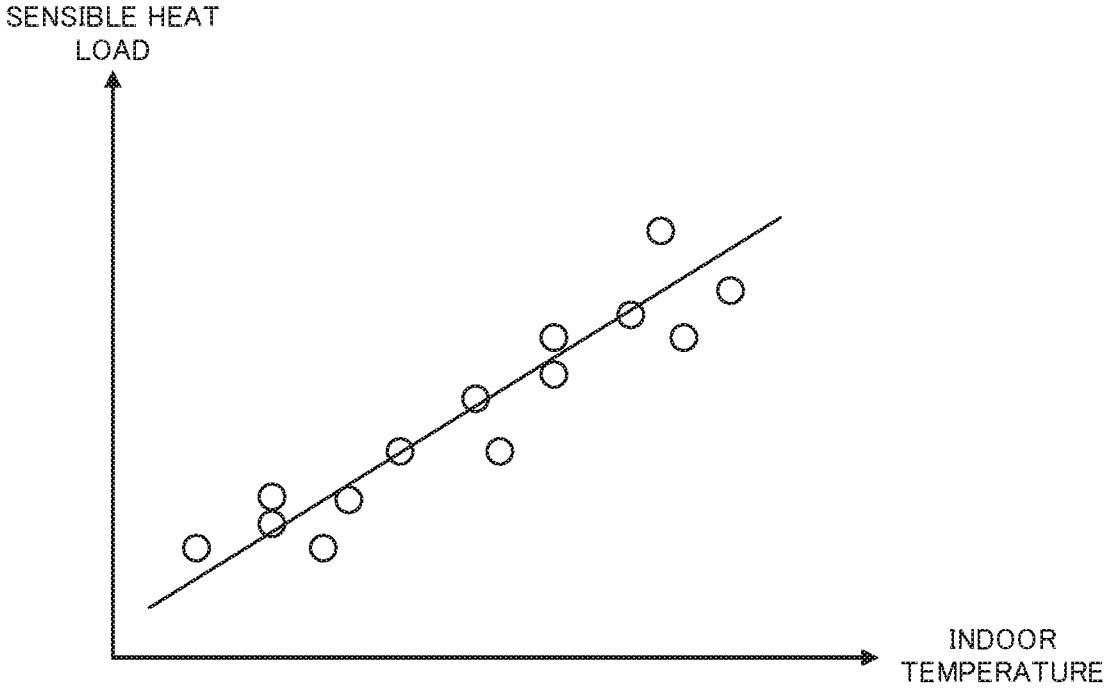
FIG. 16 is a graph illustrating a correlation between the sensible heat load and the indoor temperature.

The learner 406 generates data indicating association among the calculated current sensible heat capacity, the suction temperature (indoor temperature), the type of operation mode, and the set temperature (target indoor temperature). Then repetition of such data generation enables the learner 406 to learn and develop Relational Expression that indicates the fifth correlation as illustrated in FIG. 16.

Figure 17:
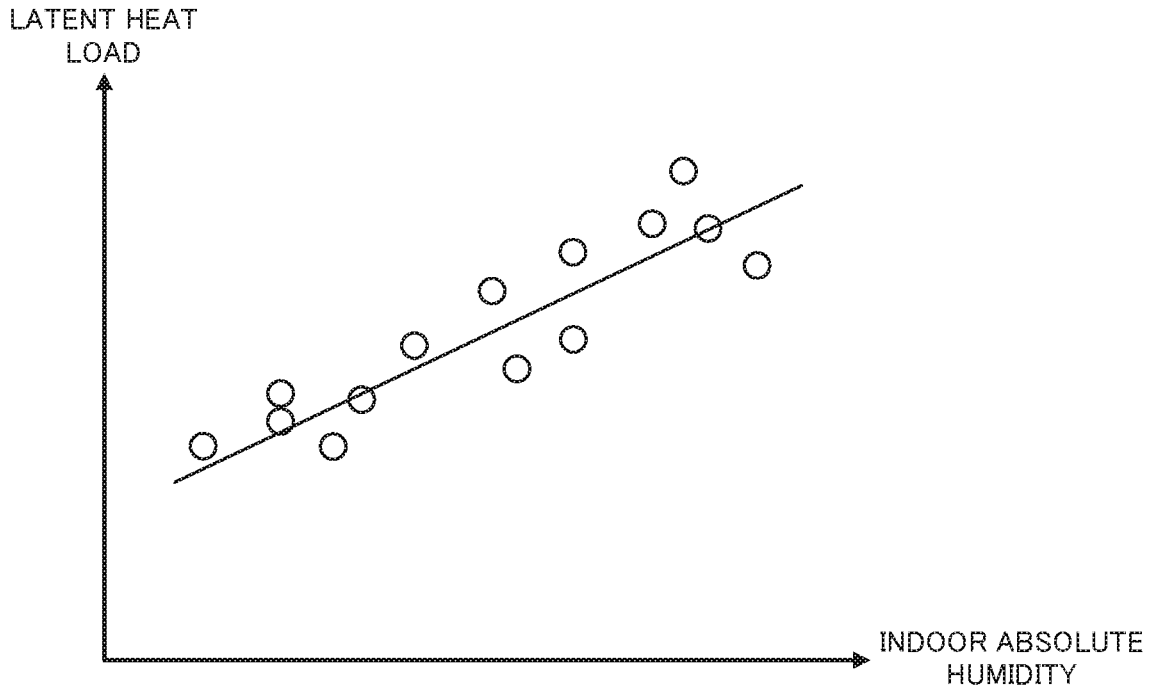
FIG. 17 is a graph illustrating a correlation between the latent heat load and an indoor absolute humidity.

The learner 406 also generates data indicating association among the calculated current latent heat capacity, the suction humidity (indoor absolute humidity), the type of operation mode, and the set temperature (target indoor temperature). Then repetition of such data generation enables the learner 406 to learn and develop Relational Expression that indicates the sixth correlation as illustrated in FIG. 17.

As described above, the air-conditioning control device 4 of the air-conditioning system according to Embodiment 2 of the present disclosure accurately detects the current sensible heat load using Relational Expression that indicates the correlation between the sensible heat load and the indoor temperature, developed through learning. Similarly, the air-conditioning control device 4 accurately detects the current latent heat load using Relational Expression that indicates the correlation between the latent heat load and the indoor absolute humidity, developed through learning.

Then the air-conditioning control device 4 determines the target value of the inlet temperature of the heat source unit 1 in accordance with the detected sensible heat load, and determines the target value of the outlet temperature of the heat source unit 1 in accordance with the detected latent heat load. Thus air-conditioning accuracy can be enhanced, which results in improved comfort and energy saving.

The sensible heat load and the latent heat load can be detected by another method without use of Relational Expression that indicates the correlation, developed through learning as described above. Another detection method is described below.

Figure 18:
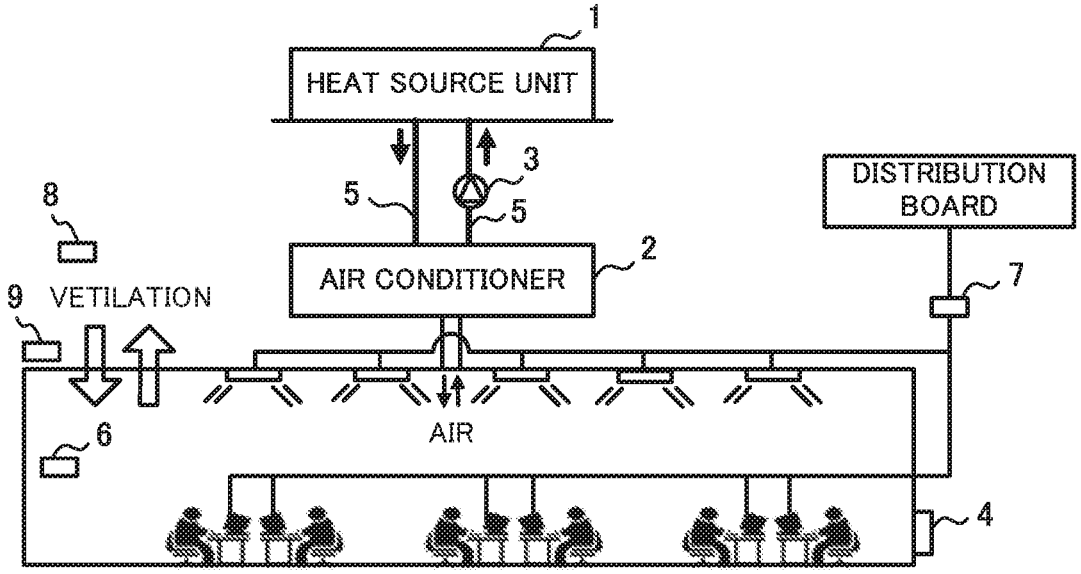
FIG. 18 is a drawing illustrating an overall configuration of an air-conditioning system according to a variation of Embodiment 2.

FIG. 18 is a drawing illustrating an overall configuration of an air-conditioning system according to a variation of Embodiment 2. The air-conditioning system further includes a count sensor 6 that counts the number of persons who are present in an indoor space, a power measurement sensor 7 that measures power consumed in the indoor space, an outdoor condition sensor 8 that measures an outdoor air condition (outdoor temperature, outdoor absolute humidity), and a ventilation air flow sensor 9 that measures a flow rate of air for ventilation.

The count sensor 6, the power measurement sensor 7, the outdoor condition sensor 8, and the ventilation air flow sensor 9 are communicatively connected to the air-conditioning control device 4 in a wired or wireless manner. The air-conditioning control device 4 acquires measurement results by these sensors at the time of start of the operation, and after the start of the operation, repeats the acquisition at regular time intervals (e.g., at one-minute intervals).

In this case, the sensible heat load detector 404 may detect the current sensible heat load by summing (i) the sensible heat load (kW) per person multiplied by the number of persons present in the indoor space, (ii) power (kW) consumed in the indoor space, and (iii) a ventilation sensible heat load (kW), (iv) ingress heat (kW) through wall. The ventilation sensible heat load (kW) is calculated based on the outdoor temperature, the indoor temperature, and the ventilation air flow rate, and the ingress heat (kW) through wall is calculated based on the a wall area, a conductivity of heat through wall, an outdoor temperature, and an indoor temperature.

The latent heat load detector 405 may detect the current latent heat load by summing (i) the latent heat load (kW) per person multiplied by the number of persons present in the indoor space and (ii) a ventilation latent heat load (kW). The ventilation latent heat load (kW) is calculated based on the outdoor absolute humidity, the indoor absolute humidity, and the ventilation air flow rate.

The present disclosure is not limited to the above embodiment, and various modifications can be of course made without departing from the scope of the invention.

For example, the air-conditioning control device 4 may send, to the water circulation device 3, a command that, instead of including the drive rotation frequency, specifies the target value of the inlet temperature of the heat source unit 1 that is determined by the target value determiner 402 or 402A. In this case, the water circulation device 3 determines the drive rotation frequency based on the specified target value.

At least one of the functions of the air-conditioning control device 4 may be implemented by the control board 17 of the heat source unit 1 or the control board 24 of the air conditioner 2.

Figure 19:
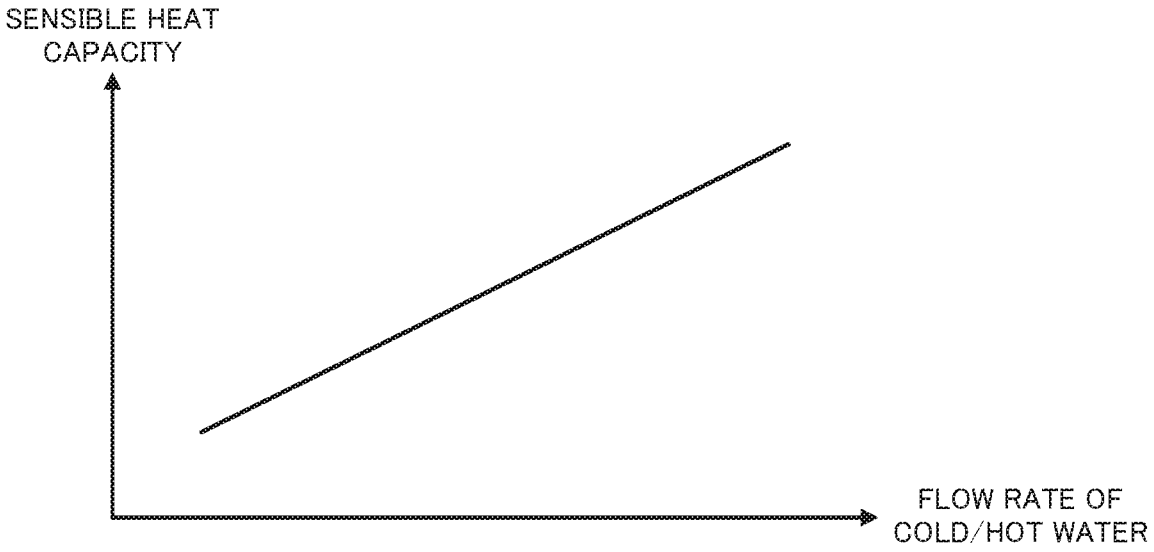
FIG. 19 is a graph illustrating a correlation between the sensible heat capacity and a flow rate of the cold/hot water.

With a configuration further including a flow sensor (not illustrated) that measures a flow rate of circulating cold/hot water, the air-conditioning control device 4 may control the water circulation device 3 not based on the temperature of cold/hot water returning back to the heat source unit 1, that is, the inlet temperature of the heat source unit 1, but based on the target value of the flow rate of cold/hot water. Since the sensible heat capacity and the flow rate of cold/hot water have a relationship as indicated in FIG. 19, the air-conditioning control device 4 controls the water circulation device 3 to reduce the flow rate of cold/hot water when the sensible heat load is low and to increase the flow rate when the sensible heat load is high.

In the above embodiments, the CPU 40 of the air-conditioning control device 4 executes the program relating to the air-conditioning control, thereby implementing each function (see FIGS. 5 and 12) of the air-conditioning control device 4. However, all or part of the functions of the functions of the air-conditioning control device 4 may be implemented by dedicated hardware. Examples of the dedicated hardware include a single circuit, a composite circuit, a programmed processor, an application specific integrated circuit (ASIC), a field-programmable gate array (FPGA), and a combination thereof.

In the above embodiments, the program to be executed by the air-conditioning control device 4 can be distributed in a form of a computer-readable recording medium storing the program, such as a compact disc read only memory (CD-ROM), a digital versatile disc (DVD), a magneto-optical disk (MO), a universal serial bus (USB) memory, a memory card, a hard disk drive (HDD), and the like. The program may be installed in a specific or general-purpose computer to enable the computer to serve as the air-conditioning control device 4 according to the above embodiments.

The above-described program may be stored on a disk device or the like of a server device on a communication network such as the Internet to enable the program to be downloaded to the computer, for example by superimposing the program onto a carrier wave.

When the above-described functions are, for example, achieved partly by an operating system (OS) and an application program or in cooperation with the OS and the application program, the program other than the OS may be stored on the above recording medium for distribution or may be downloaded to the computer.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The present disclosure may be used with advantage in an air-conditioning system for conditioning air in a building using water.

The invention claimed is:

1. An air-conditioning system comprising:

a heat source unit configured to supply temperature-controlled water;

an air conditioner configured to perform heat exchange between the water supplied by the heat source unit and air taken in from an indoor space;

a water circulator configured to circulate the water between the heat source unit and the air conditioner; and a control device comprising a central processing unit (CPU), a communication interface, and a memory, wherein the CPU is configured to determine a target value of an outlet temperature of the heat source unit using a predefined correlation between the target value of the outlet temperature of the heat source unit and a latent heat load of the indoor space, and control the heat source unit such that the outlet temperature of the heat source unit reaches the determined target value of the outlet temperature, and determine a target value of an inlet temperature of the heat source unit using a predefined correlation between the target value of the inlet temperature of the heat source unit and a sensible heat load of the indoor space, and control a discharge rate of the water circulator such that the inlet temperature of the heat source unit reaches the determined target value of the inlet temperature.

2. The air-conditioning system according to claim 1, wherein the CPU is further configured to learn, by a learner, a correlation between an indoor latent heat load and an indoor humidity of the indoor space by repeating at regular time intervals a process of (i) calculating a latent heat capacity of the air conditioner and (ii) generating data that indicates association between the calculated latent heat capacity and the indoor humidity, and a correlation between an indoor sensible heat load and an indoor temperature of the indoor space by repeating at regular time intervals a process of (i) calculating a sensible heat capacity of the air conditioner and (ii) generating data that indicates association between the calculated sensible heat capacity and the indoor temperature.

3. The air-conditioning system according to claim 2, wherein the learner calculates the latent heat capacity of the air conditioner based on humidity of air taken in by the air conditioner, humidity of air blown from the air conditioner, and a flow rate of air blown from the air conditioner, and calculates the sensible heat capacity of the air conditioner based on temperature of the air taken in by the air conditioner, temperature of the air blown from the air conditioner, and the flow rate of the air blown from the air conditioner.

4. The air-conditioning system according to claim 1, wherein the CPU is further configured to detect, by a latent heat load detector, an indoor latent heat load based on a number of persons present in the indoor space, the indoor humidity, an outdoor humidity, and a ventilation air flow rate of the indoor space, and detect, by a sensible heat load detector, an indoor sensible heat load based on the number of persons present in the indoor space, power consumed in the indoor space, the indoor temperature, an outdoor temperature, and the ventilation air flow rate.

5. The air-conditioning system according to claim 1, wherein the CPU is further configured to use an indoor humidity of the indoor space as an indoor latent heat load and use an indoor temperature of the indoor space as an indoor sensible heat load.

6. An air-conditioning control device for control of:

a heat source unit configured to supply temperature-controlled water; and a water circulator configured to circulate the water between the heat source unit and an air conditioner, the air-conditioning control device comprising a central processing unit (CPU), a communication interface, and a memory, wherein the CPU is configured to determine a target value of an outlet temperature of the heat source unit using a predefined correlation between the target value of the outlet temperature of the heat source unit and a latent heat load of the indoor space, and control the heat source unit such that the outlet temperature of the heat source unit reaches the determined target value of the outlet temperature, and determine a target value of an inlet temperature of the heat source unit using a predefined correlation between the target value of the inlet temperature of the heat source unit and a sensible heat load of the indoor space, and control a discharge rate of the water circulator such that the inlet temperature of the heat source unit reaches the determined target value of the inlet temperature.

7. The air-conditioning control device according to claim 6, wherein the CPU is further configured to learn, by a learner, a correlation between an indoor latent heat load and an indoor humidity of the indoor space by repeating at regular time intervals a process of (i) calculating a latent heat capacity of the air conditioner and (ii) generating data that indicates association between the calculated latent heat capacity and the indoor humidity, and a correlation between an indoor sensible heat load and an indoor temperature of the indoor space by repeating at regular time intervals a process of (i) calculating a sensible heat capacity of the air conditioner and (ii) generating data that indicates association between the calculated sensible heat capacity and the indoor temperature.

8. The air-conditioning control device according to claim 7, wherein the learner calculates the latent heat capacity of the air conditioner based on humidity of air taken in by the air conditioner, humidity of air blown from the air conditioner, and a flow rate of air blown from the air conditioner, and calculates the sensible heat capacity of the air conditioner based on temperature of the air taken in by the air conditioner, temperature of the air blown from the air conditioner, and the flow rate of the air blown from the air conditioner.

9. The air-conditioning control device according to claim 6, wherein the CPU is further configured to detect, by a latent heat load detector, an indoor latent heat load based on a number of persons present in the indoor space, the indoor humidity, an outdoor humidity, and a ventilation air flow rate of the indoor space, and detect, by a sensible heat load detector, an indoor sensible heat load based on the number of persons present in the indoor space, power consumed in the indoor space, the indoor temperature, an outdoor temperature, and the ventilation air flow rate.

10. The air-conditioning control device according to claim 6, wherein the CPU is further configured to use an indoor humidity of the indoor space as an indoor latent heat load and use an indoor temperature of the indoor space as an indoor sensible heat load.

11. An air-conditioning method, performed by an air-conditioning system including a heat source unit configured to supply temperature-controlled water, an air conditioner configured to perform heat exchange between the water supplied by the heat source unit and air taken in from an indoor space, and a water circulator configured to circulate the water between the heat source unit and the air conditioner, the air-conditioning method comprising:

determining a target value of an outlet temperature of the heat source unit using a predefined correlation between the target value of the outlet temperature of the heat source unit and a latent heat load of the indoor space, and controlling the heat source unit such that the outlet temperature of the heat source unit reaches the determined target value of the outlet temperature, and determining a target value of an inlet temperature of the heat source unit using a predefined correlation between the target value of the inlet temperature of the heat source unit and a sensible heat load of the indoor space, and controlling a discharge rate of the water circulator such that the inlet temperature of the heat source unit reaches the determined target value of the inlet temperature.

12. The air-conditioning method according to claim 11, further comprising learning, by the air-conditioning system:

a correlation between an indoor latent heat load and an indoor humidity of the indoor space by repeating at regular time intervals a process of (i) calculating a latent heat capacity of the air conditioner and (ii) generating data that indicates association between the calculated latent heat capacity and the indoor humidity, and a correlation between an indoor sensible heat load and an indoor temperature of the indoor space by repeating at regular time intervals a process of (i) calculating a sensible heat capacity of the air conditioner and (ii) generating data that indicates association between the calculated sensible heat capacity and the indoor temperature.

13. The air-conditioning method according to claim 12, further comprising, by the air-conditioning system, calculating the latent heat capacity of the air conditioner based on humidity of air taken in by the air conditioner, humidity of air blown from the air conditioner, and a flow rate of air blown from the air conditioner, and calculating the sensible heat capacity of the air conditioner based on temperature of the air taken in by the air conditioner, temperature of the air blown from the air conditioner, and the flow rate of the air blown from the air conditioner.

14. The air-conditioning method according to claim 11, further comprising, by the air-conditioning system, detecting, by a latent heat load detector, an indoor latent heat load based on a number of persons present in the indoor space, the indoor humidity, an outdoor humidity, and a ventilation air flow rate of the indoor space, and detecting, by a sensible heat load detector, an indoor sensible heat load based on the number of persons present in the indoor space, power consumed in the indoor space, the indoor temperature, an outdoor temperature, and the ventilation air flow rate.

15. The air-conditioning method according to claim 11, further comprising, by the air-conditioning system, using an indoor humidity of the indoor space as an indoor latent heat load and using an indoor temperature of the indoor space as an indoor sensible heat load.

16. A non-transitory computer-readable recording medium storing a program executable by a computer for controlling a heat source unit configured to supply temperature-controlled water and a water circulator configured to circulate the water between the heat source unit and an air conditioner, the program causing the computer to:

determine a target value of an outlet temperature of the heat source unit using a predefined correlation between the target value of the outlet temperature of the heat source unit and a latent heat load of the indoor space, and control the heat source unit such that the outlet temperature of the heat source unit reaches the determined target value of the outlet temperature, and determine a target value of an inlet temperature of the heat source unit using a predefined correlation between the target value of the inlet temperature of the heat source unit and a sensible heat load of the indoor space, and control a discharge rate of the water circulator such that the inlet temperature of the heat source unit reaches the determined target value of the inlet temperature.

17. The non-transitory computer-readable recording medium according to claim 16, wherein the program further causes the computer to learn:

a correlation between an indoor latent heat load and an indoor humidity of the indoor space by repeating at regular time intervals a process of (i) calculating a latent heat capacity of the air conditioner and (ii) generating data that indicates association between the calculated latent heat capacity and the indoor humidity, and a correlation between an indoor sensible heat load and an indoor temperature of the indoor space by repeating at regular time intervals a process of (i) calculating a sensible heat capacity of the air conditioner and (ii) generating data that indicates association between the calculated sensible heat capacity and the indoor temperature.

18. The non-transitory computer-readable recording medium according to claim 17, wherein the program further causes the computer to calculate the latent heat capacity of the air conditioner based on humidity of air taken in by the air conditioner, humidity of air blown from the air conditioner, and a flow rate of air blown from the air conditioner, and calculate the sensible heat capacity of the air conditioner based on temperature of the air taken in by the air conditioner, temperature of the air blown from the air conditioner, and the flow rate of the air blown from the air conditioner.

19. The non-transitory computer-readable recording medium according to claim 16, wherein the program further causes the computer to detect, by a latent heat load detector, an indoor latent heat load based on a number of persons present in the indoor space, the indoor humidity, an outdoor humidity, and a ventilation air flow rate of the indoor space, and detect, by a sensible heat load detector, an indoor sensible heat load based on the number of persons present in the indoor space, power consumed in the indoor space, the indoor temperature, an outdoor temperature, and the ventilation air flow rate.

20. The non-transitory computer-readable recording medium according to claim 16, wherein the program further causes the computer to use an indoor humidity of the indoor space as an indoor latent heat load and use an indoor temperature of the indoor space as an indoor sensible heat load.

* * * * *